US008377223B2

(12) United States Patent
Classen

(10) Patent No.: US 8,377,223 B2
(45) Date of Patent: Feb. 19, 2013

(54) METHOD FOR ELIMINATING ODORS IN A DISHWASHER MACHINE

(75) Inventor: Egbert Classen, Wertingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1710 days.

(21) Appl. No.: 11/634,727

(22) Filed: Dec. 5, 2006

(65) Prior Publication Data

US 2007/0131259 A1 Jun. 14, 2007

(30) Foreign Application Priority Data

Dec. 8, 2005 (DE) ..... 10 2005 058 662

(51) Int. Cl.
*B08B 3/02* (2006.01)

(52) U.S. Cl. ..... 134/25.2; 134/42

(58) Field of Classification Search ..... 134/25.2, 134/42

See application file for complete search history.

(56) References Cited

U.S. PATENT DOCUMENTS

| | | | |
|---|---|---|---|
| 2002/0153021 | A1 | 10/2002 | Audet |
| 2003/0080068 | A1 | 5/2003 | Koslow et al. |
| 2005/0160528 | A1 | 7/2005 | Clark et al. |

FOREIGN PATENT DOCUMENTS

| | | | |
|---|---|---|---|
| DE | 22 20 189 | | 11/1973 |
| DE | 200 14 633 U | | 11/2000 |
| DE | 100 36 850 | | 10/2001 |
| EP | 0 869 156 | | 10/1998 |
| FR | 2 547 733 | | 12/1984 |
| JP | 2005-118209 | * | 5/2005 |
| JP | 2005-143881 | * | 6/2005 |
| KR | 10-2004-000336 | | 7/2005 |
| WO | WO98/12048 | | 3/1998 |
| WO | WO-98/12048 | * | 3/1998 |

OTHER PUBLICATIONS

English Translation for JP-2005-143881.*
English translation of JP-20050118209.*
English translation of WO-98/12048.*

* cited by examiner

*Primary Examiner* — Saeed T Chaudhry
(74) *Attorney, Agent, or Firm* — James E. Howard; Andre Pallapies

(57) ABSTRACT

A method for operating a dishwasher machine (1), in particular a domestic dishwasher machine, in which in order to eliminate odors, the air located in a washing container (2) is passed by a photocatalytic layer (5) exposed to a light source (6) in order to oxidise the odour-forming molecules contained in the air. According to the invention, this is carried out during a standstill phase of the dishwasher machine (1).

14 Claims, 1 Drawing Sheet

METHOD FOR ELIMINATING ODORS IN A DISHWASHER MACHINE

The invention relates to a method for operating a dishwasher machine, in particular a domestic dishwasher machine, in which in order to eliminate odors, the air located in a washing container is exposed to a photocatalytic layer illuminated by a light source in order to oxidise the odour-forming molecules contained in the air, as well as a relevant dishwasher machine.

BACKGROUND OF THE INVENTION

In practice, the duration of the standstill phase of a dishwasher machine, that is the time interval between two wash cycles, can be several days. During this standstill phase the dishwasher machine is usually opened and closed again many times to insert dirty items to be washed. Organic constituents on the items to be washed are rapidly decomposed by bacteria as a result of the advantageous conditions prevailing in the interior of a dishwasher machine such as, for example, the temperature, the high humidity, darkness and the enclosed space. This is associated with unpleasant odors which flow towards the user of the dishwasher machine every time the door is opened. The odors are only eliminated by putting the dishwasher machine into operation again.

It would therefore be desirable to provide a dishwasher machine where the user is not exposed to such unpleasant odors even after a fairly long standstill phase.

For sterilising rinsing water, e.g. after a fairly long stoppage time of the dishwasher machine, DE 22 20 189 C2 proposes a dishwasher machine which comprises a UV emitter in the water supply line after the water softener. Similarly, DE 200 14 633 U1 proposes to illuminate the inner area of the dishwasher machine with UV light for the purposes of sterilisation or disinfection. In both cases, however the problem of unpleasant odors during a fairly long standstill phase is not solved with dirty items to be washed stored in the dishwasher machine.

DE 100 36 850 A1 discloses a device and a method for delivering a liquid product with a fragrance-producing or odour-absorbing or antimicrobial-acting active substance in the interior of a dishwasher machine. The device is actuated every time the door of the dishwasher machine is closed. Since the device for delivering the liquid product needs to be exchanged at regular intervals, additional costs are incurred in this case for the user of the dishwasher machine. In addition, it is questionable whether the odour-absorbing substance delivered by the device can still provide its effect to a satisfactory extent after the door has not been actuated for a fairly long time.

For masking odors by incorporating odiferous substances, DE 83 15 008 U1 proposes a disk of plastic material impregnated with an odiferous substance. The device is provided for use in the crockery basket of the dishwasher machine and remains permanently therein. After each crockery wash cycle, the desired improvement in odour occurs as a result of the elevated temperature. No odour improvement can be provided with this arrangement during the standstill phase.

WO 98/12048 discloses the provision of a thin photocatalytic film for use in air flow channels, filter devices and in sections in electrical appliances exposed to a built-in illumination device. This film has an enhanced catalytic effect as a result of various additives. The film can decompose organic substances which are the cause of odors in the air even in weak light. Use within the scope of a wash cycle of a dishwasher machine is described.

EP 0 869 156 B 1 discloses a composite material having a surface which can be made hydrophilic. In this material, one layer contains a photocatalyst consisting of titanium dioxide, photoexcitation being carried out to allow water molecules to adsorb physically onto the surface.

US 2002/0153021 A1 describes an industrial dishwasher machine provided with a conveying device through a washing and a drying zone. The items to be treated by this device are subjected to air drying combined with UV irradiation.

The devices and methods disclosed in the prior art disclose various possibilities for keeping items to be washed in a dishwasher machine as well as the interior of the dishwasher machine sterilised as well as improving odors by means of odiferous substances which are mounted in a storage means and released in a manner coupled to a wash cycle or the actuation of the door. However, the procedures known from the prior art only provide odour improvement to a certain extent since the proposed measures are linked to the execution of a wash cycle or the presence of odiferous substances.

SUMMARY OF THE INVENTION

It is therefore the object of the present invention to provide a method for operating a dishwasher machine which avoids the occurrence of unpleasant odors when opening the door as a result of decomposition processes taking place in the interior of the dishwasher and to provide a relevant dishwasher machine.

This object is achieved according to the invention by a method for operating a dishwasher machine, in particular a domestic dishwasher machine, in which, in order to eliminate odors, the air located in a washing container is exposed to a photocatalytic layer illuminated by a light source in order to oxidise the odour-forming molecules contained in the air, wherein this takes place according to the invention during a standstill phase of the wash cycle of the dishwasher machine in order to eliminate odors from the washing container by the next wash cycle.

The concept of the "standstill phase" is to be understood as the time interval between the end and the beginning of a consecutive wash cycle. Unpleasant odors produced as a result of foul gases are neutralised by passing the air located in the washing container past a photocatalytic layer exposed to a light source. Contrary to the methods known from the prior art, the neutralisation does not take place during a wash cycle or immediately following a wash cycle but during a standstill phase of the dishwasher machine in which this is occupied with dirty items to be washed.

In a further development of the method according to the invention, titanium dioxide applied to a carrier material, in particular in the form of anatase, is used as the photocatalytic layer. The particles of the titanium dioxide preferably have radii in the nanometer range. The titanium dioxide is used as a photocatalyst which continuously cleans the air located in the dishwasher machine in the presence of light. The photocatalytic process functions both with artificial light and with daylight so that both solar radiation and an artificial light source can be used as the light source. Light having a wavelength in the ultraviolet range is preferably emitted by the light source.

The photocatalytic layer converts undesirable odors of organic origin at the surface into harmless substances, thus neutralising the foul gases produced in the dishwasher machine. The titanium dioxide is used as a catalyst. This semiconductor is reactive on exposure to UV light and triggers a photochemical reaction in the substances causing the odour nuisance. These organic molecules can thus be oxidised under the influence of light. Since titanium dioxide is corrosion-resistant and non-toxic, the photocatalytic layer can be applied directly to the surface of the washing container.

According to a further preferred embodiment, the cleaning effect and odour neutralisation of the photocatalytic layer can be increased by circulating the air located in the washing container during the standstill phase of the dishwasher machine in order to guide the air past the photocatalytic layer. This can be effected by providing a suitably embodied fan.

A further embodiment provides that the exposure of the photocatalytic layer and/or the circulation of the air located in the washing container is sensor- or time-controlled. A sensor designed for this purpose could, for example, detect odors, putrefaction, or the opening and closing of the door after each loading process. If the exposure of the photocatalytic layer is coupled to the opening and closing of the door after each loading process, it can possibly be advantageous to carry this out with a time offset so that the time-delayed decomposition process of the contaminants located on the items to be washed is taken into account.

Regardless of any sensing, the exposure of the photocatalytic layer and therefore the cleaning of the air located in the washing container as well as the odour neutralisation can be carried out at pre-determined, e.g. regular time intervals.

From energy-saving aspects, it is appropriate if, according to a further embodiment, the exposure of the photocatalytic layer is carried out only temporarily. In addition, it is also feasible that the exposure of the photocatalytic layer is carried out permanently during the standstill phase of the dishwasher machine.

In a further embodiment it is provided that the light source for exposure of the photocatalytic layer is only switched on during circulation of the air in the washing container. In this way, an energy-efficient and particularly fast cleaning of the air and odour neutralisation can be achieved.

It can furthermore be appropriate to guide air from the washing container through an odour neutralisation device and back into the washing container, wherein the odour neutralisation device contains the photocatalytic layer on which the odour-forming molecules contained in the air are oxidised as they pass through. In other words, it is provided to pass the air located in the washing container through an odour neutralisation device embodied as a bypass to the washing container for cleaning purposes. This has the advantage that the photocatalytic layer and the light source need not be arranged in the interior of the washing container. This simplifies the arrangement of catalytic layer and light source with respect to one another.

Another embodiment of the method according to the invention has the subject matter that the odour neutralisation device comprises the light source in order to expose the photocatalytic layer during passage of the air through the odour neutralisation device.

BRIEF DESCRIPTION OF THE DRAWINGS

The invention is explained in detail hereinafter with reference to the figures. In the figures.

DETAILED DESCRIPTION OF THE EXEMPLARY EMBODIMENTS OF THE PRESENT INVENTION

Figure 1:
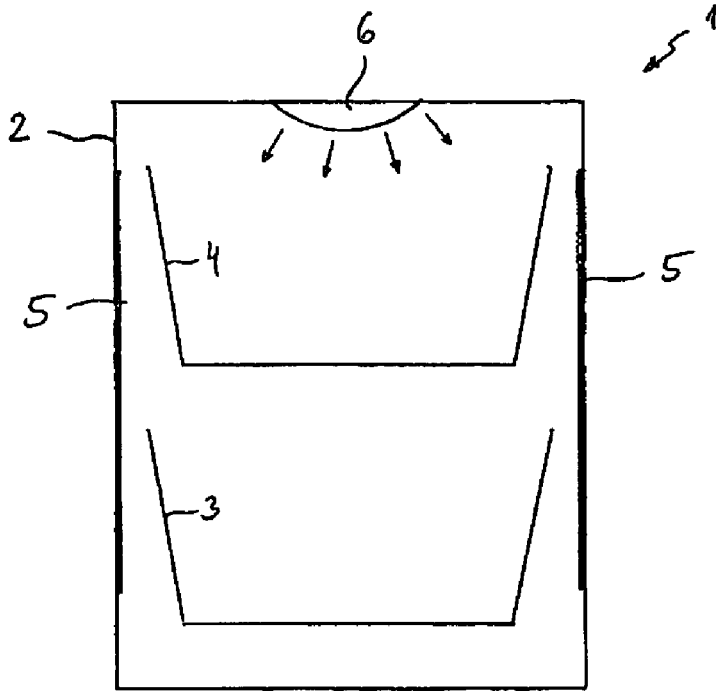
FIG. 1 is a first exemplary embodiment of a dishwasher machine according to the invention for carrying out the method according to the invention and FIG. 2 is a second exemplary embodiment of a dishwasher machine according to the invention for carrying out the method according to the invention.

FIG. 1 is a schematic diagram of a dishwasher machine 1 according to the invention, comprising a washing container 2 in which crockery baskets 3, 4 for arranging items to be washed, not shown, are disposed. The dishwasher machine has a photocatalytic layer 5 of titanium dioxide, for example, on its opposite side walls. The titanium dioxide can be applied directly to the walls of the washing container or to a suitable carrier material located on said washing container walls. An artificial light source 6 disposed merely as an example on the container roof is designed to expose the photocatalytic layer 5 to light in the ultraviolet range during a standstill phase of the dishwasher machine.

Figure 2:
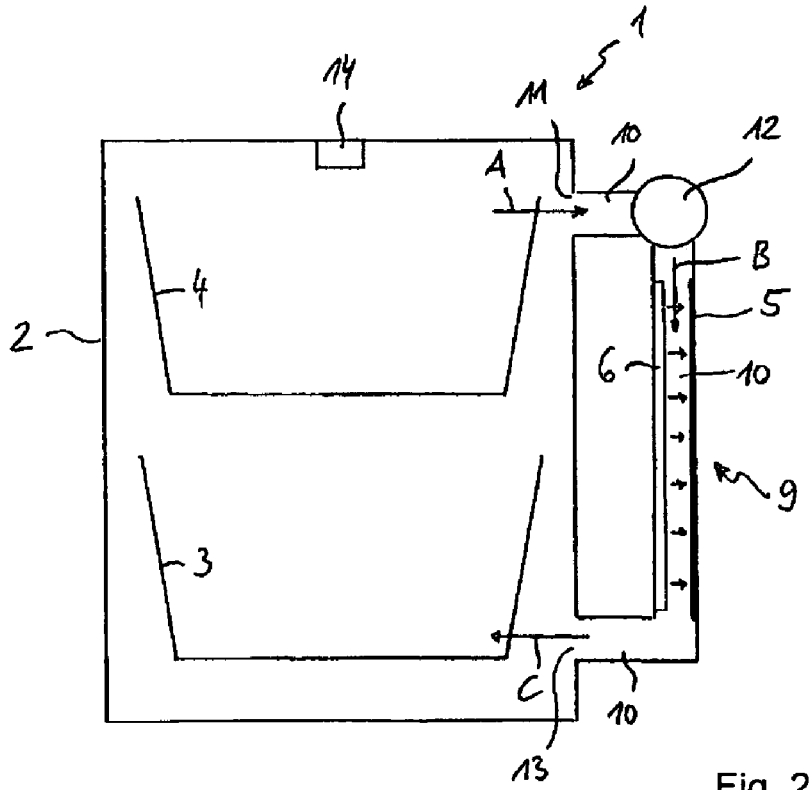

In the exemplary embodiment according to FIG. 2, there is provided an odour neutralisation device 9 which is connected to the washing container 2 by means of an inlet opening 11 and an outlet opening 13. A fan 12 disposed in a duct 10 sucks air from the washing container 2 into the inlet opening 11 (see flow direction A) and guides this along the light source 6 disposed opposedly in the duct 10 and the photocatalytic layer 5 through the duct 10, whereupon the air purified from odors is supplied back into the washing container 2 via the outlet opening 12. The direction of flow of the air is indicated by the arrows characterised by the letters A, B, C.

The odour neutralisation device 9 forms a bypass through which the air having undesirable odors is passed for cleaning and odour neutralisation. The provision of the odour neutralisation device 9 allows the light source 6 and photocatalytic layer 5 to be arranged in spatial proximity to one another so that said device can be exposed to the light source, free from shadows, directly and over a large area. In addition, it is not necessary to use light sources which are particularly protected against the penetration of moisture.

The exemplary embodiment according to FIG. 2 additionally comprises a sensor 14 which is merely disposed on the container roof of the washing container 2 for diagrammatic reasons. The sensor 14 can comprise a sensor which detects undesirable odors or putrefaction. However, the sensor 14 can also be operatively connected to the door (not shown) of the dishwasher machine 1 in order to operate the odour neutralisation device 9, for example, after opening and closing the door during a standstill phase, optionally offset in time.

The photocatalytic layer is then exposed when the dishwasher is located in a standstill phase, that is in the time interval between two consecutive wash cycles. The odour neutralisation is particularly efficient in this case since during this standstill phase, dirty items to be washed are located in the washing container for a fairly long time during which the impurities are decomposed by bacteria. It is therefore necessary for the photocatalytic cleaning device to be operated for the first time from the instant when dirty items to be washed are loaded into the washing container. The sensor could therefore also be embodied as an optical sensor which monitors the loading of the washing container of the dishwasher machine 1 with dirty crockery.

Such a sensor could also be arranged in the exemplary embodiment in FIG. 1 contrary to the diagrammatic representation.

It is possible to operate the light source permanently so that the photocatalytic layer 5 is continuously exposed. This also brings about continuous cleaning and odour neutralisation of the air located in the washing container.

In another embodiment, it can be appropriate for reasons of optimising energy to operate the light source merely intermittently so that merely intermittent exposure of the photocatalytic layer and therefore merely intermittent cleaning of the air takes place.

Any arbitrary light source capable of emitting ultraviolet light can be used as the light source. In particular, it is also possible to use solar radiation as the light source if the photocatalytic layer is arranged in a section of the washing container or the duct 10 of the odour neutralisation device which is accessible to solar radiation.

Whereas in the exemplary embodiment according to FIG. 2, the air is circulated through the odour neutralisation device 9 by the fan 12, circulation of the air is not necessarily provided in the exemplary embodiment according to FIG. 1 but is optionally possible by providing a fan.

The invention provides a method for operating a dishwasher machine which allows dirty items to be washed to be stored in the dishwasher machine during a fairly prolonged standstill phase without unpleasant odors being produced as a result of bacterial decomposition of impurities of the items to be washed.

REFERENCE LIST

1 Dishwasher machine
2 Washing container
3 Crockery basket
4 Crockery basket
5 Photocatalytic layer
6 Light source
7 Outlet opening
8 Duct
9 Odour neutralisation device
10 Duct
11 Inlet opening
12 Fan
13 Outlet opening
14 Sensor
15 A, B, C Direction of air flow

The invention claimed is:

1. A method for operating a dishwasher machine including a washing container, a photocatalytic layer, and a light source that illuminates the photocatalytic layer, the method comprising:

unloading a first set of clean items from the washing container after a first wash cycle of the dishwasher machine is completed;

loading a second set of dirty items into the washing container to be washed in a second wash cycle of the dishwasher machine;

illuminating the photocatalytic layer using the light source and exposing air in the washing container of the dishwasher machine to the photocatalytic layer illuminated by the light source such that odor-forming molecules contained in the air are oxidized with the exposure of the air in the washing container of the dishwasher machine occuring during a standstill phase of the dishwasher machine that is a phase, following a completion of the first wash cycle and the unloading of the first set of clean items from the washing container, during which the second set of dirty items to be washed by the dishwasher machine have been loaded into the washing container of the dishwasher machine and prior to commencement of the second wash cycle of the dishwasher machine that will wash the second set of dirty items, whereby odors are eliminated from the washing container before the commencement of the second wash cycle to wash the second set of dirty items, wherein the exposing the air in the dishwasher machine to the photocatalytic layer includes:

circulating the air located in the washing container during the standstill phase of the dishwasher machine in order to guide the air past the photocatalytic layer, the circulating being controlled to start and stop based on one of a sensor and a timer;

switching on the light source for exposure of the air to the photocatalytic layer only during the circulating of the air in the washing container; and switching off the light source when the air is not circulating in the washing container.

2. The method according to claim 1, wherein exposing air in the dishwasher machine to a photocatalytic layer includes exposing air in the dishwasher machine to a photocatalytic layer composed of titanium dioxide applied to a carrier material.

3. The method according to claim 1, wherein exposing air in the dishwasher machine to a photocatalytic layer includes exposing air in the dishwasher machine to a photocatalytic layer that has been illuminated by a light source emitting light having a wavelength in the ultraviolet range.

4. The method according to claim 1, wherein exposing air in the dishwasher machine to a photocatalytic layer includes exposing air in the dishwasher machine to a photocatalytic layer that has been illuminated by a solar radiation light source.

5. The method according to claim 1, wherein exposing air in the dishwasher machine to a photocatalytic layer includes exposing air in the dishwasher machine to a photocatalytic layer that has been illuminated by an artificial light source.

6. The method according to claim 1, wherein exposing air in the dishwasher machine to a photocatalytic layer includes circulating the air located in the washing container during the standstill phase of the dishwasher machine in order to guide the air past the photocatalytic layer.

7. The method according to claim 1, wherein exposing air in the dishwasher machine to a photocatalytic layer includes a selected one of circulating the air located in the washing container during the standstill phase of the dishwasher machine in order to guide the air past the photocatalytic layer and not circulating the air located in the washing container during the standstill phase of the dishwasher during the exposure of the air to the photocatalytic layer and exposing air in the dishwasher machine to a photocatalytic layer includes controlling such exposure of the air to the photocatalytic layer in a selected one of a sensor-controlled manner and a time-controlled manner.

8. The method according to claim 1, wherein exposing air in the dishwasher machine to a photocatalytic layer includes intermittently exposing the air to the photocatalytic layer.

9. The method according to claim 1, wherein exposing air in the dishwasher machine to a photocatalytic layer includes guiding air from the washing container through an odor neutralisation device and back into the washing container, wherein the odor neutralisation device contains the photocatalytic layer on which the odor-forming molecules contained in the air are oxidised as they pass through.

10. The method according to claim 9, wherein exposing air in the dishwasher machine to a photocatalytic layer includes guiding air from the washing container through an odor neutralisation device that includes the light source in order to expose the photocatalytic layer during passage of the air through the odor neutralisation device.

11. The method according to claim 1, wherein the dishwasher machine includes a door, and the photocatalytic layer is illuminated by a light source when the door of the dishwasher machine is in a closed position.

12. A method for operating a dishwasher having a plurality of wash cycles, the dishwasher including a housing, a washing container in the housing, and a door for accessing the washing container, the method comprising:

completing a first wash cycle during which items to be washed by the dishwasher have been placed in the washing container of the dishwasher;

after completing the first wash cycle and during a standstill phase of the dishwasher, which is a phase following a completion of the first wash cycle and an unloading of the items from the washing container during which a second set of dirty items to be washed by the dishwasher have been loaded into the washing container of the dishwasher and prior to commencement of a second wash cycle of the dishwasher that will wash the second set of dirty items, whereby odors are eliminated from the washing container before the commencement of the second wash cycle to wash the second set of dirty items, illuminating a photocatalytic layer using a light source and exposing air in the dishwasher to the photocatalytic layer illuminated by the light source and oxidizing odor-forming molecules contained in the air, thereby eliminating odors from the washing container before a commencement of the second wash cycle to wash the second set of dirty items; and after the standstill phase, commencing the second wash cycle to wash the second set of dirty items, wherein the exposing the air in the dishwasher to the photocatalytic layer includes switching on the light source for exposure of the air to the photocatalytic layer during circulating of the air in the washing container and switching off the light source when the air is not circulating in the washing container.

13. The method according to claim 12, wherein the exposing the air in the dishwasher to the photocatalytic layer comprises exposing the air in the washing container of the dishwasher to the photocatalytic layer in the washing container.

14. The method according to claim 12, wherein the photocatalytic layer is illuminated by the light source when the door of the dishwasher is in a closed position.

* * * * *